US010304673B2

(12) United States Patent
Giles et al.

(10) Patent No.: US 10,304,673 B2
(45) Date of Patent: May 28, 2019

(54) ION GUIDE

(71) Applicant: Micromass UK Limited, Wilmslow, Cheshire (GB)

(72) Inventors: Kevin Giles, Stockport (GB); David Gordon, Middlewich (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/278,347

(22) Filed: Sep. 28, 2016

(65) Prior Publication Data

US 2017/0092477 A1 Mar. 30, 2017

(30) Foreign Application Priority Data

Sep. 28, 2015 (GB) ..... 1517068.1

(51) Int. Cl.
*H01J 49/00* (2006.01)
*H01J 49/06* (2006.01)

(52) U.S. Cl.
CPC ..... *H01J 49/062* (2013.01); *H01J 49/0027* (2013.01); *H01J 49/065* (2013.01)

(58) Field of Classification Search
None
See application file for complete search history.

(56) References Cited

U.S. PATENT DOCUMENTS 7,952,070 B2 5/2011 Senko et al.
9,373,489 B2 6/2016 Giles
9,412,575 B2 8/2016 Green et al.
2003/0001088 A1* 1/2003 Bateman ..... H01J 49/062 250/287
2009/0014641 A1* 1/2009 Bateman ..... H01J 49/062 250/282
2009/0278043 A1* 11/2009 Satake ..... H01J 49/065 250/290
2009/0294662 A1* 12/2009 Belov ..... H01J 49/066 250/291
2011/0049357 A1* 3/2011 Giles ..... H01J 49/062 250/283
2011/0266435 A1* 11/2011 Hoyes ..... G01N 27/622 250/282
2014/0158878 A1* 6/2014 Green ..... H01J 49/065 250/282
2014/0191123 A1* 7/2014 Wildgoose ..... H01J 49/061 250/282

(Continued)

FOREIGN PATENT DOCUMENTS

GB 2392005 2/2004
WO 2015/136266 9/2015

*Primary Examiner* — Michael J Logie
(74) *Attorney, Agent, or Firm* — Womble Bond Dickinson (US) LLP; Deborah M. Vernon; Heath T. Misley

(57) ABSTRACT

An ion guide comprises a first ion guide portion that forms a first ion guiding path and a second ion guide portion that forms a second ion guiding path. A first device applies a plurality of different first voltages or potentials to the electrodes of the first ion guide portion in order to generate an electric field that directs ions from the first ion guiding path of the first ion guide portion into the second ion guiding path of the second ion guide portion. The use of plural different first voltages can provide a controlled transfer of ions from the first ion guiding path into the second ion guiding path.

3 Claims, 9 Drawing Sheets

(56) References Cited

U.S. PATENT DOCUMENTS

2014/0312222 A1* 10/2014 Giles ..... G01N 27/622
250/283
2014/0353487 A1 12/2014 Giles et al.

* cited by examiner

ION GUIDE

CROSS-REFERENCE TO RELATED APPLICATION

This application claims priority from and the benefit of United Kingdom patent application No. 1517068.1 filed on 28 Sep. 2015. The entire contents of that application are incorporated herein by reference.

FIELD OF THE INVENTION

The present invention relates generally to mass spectrometry and in particular to an ion guide, a mass spectrometer, a method of guiding ions and a method of mass spectrometry.

BACKGROUND

Ion guides are known wherein ions are confined or constrained to move along the central longitudinal axis of a linear ion guide. The central axis of the ion guide is coincident with the centre of a radially symmetric pseudo-potential valley. The pseudo-potential valley is formed within the ion guide as a result of applying RF voltages to the electrodes comprising the ion guide. Ions enter and exit the ion guide along the central longitudinal axis of the ion guide.

Ion guides are also known having first and second linear ion guide portions which are conjoined. Ions are confined or constrained to move along the central axis of the first ion guide portion of the ion guide or along the central axis of a second ion guide portion of the ion guide. Ions can be radially transferred back and forth from the first ion guide portion to the second ion guide portion as desired by applying a potential difference between the two ion guide portions.

A problem with the known ion guide having first and second linear ion guide portions which are conjoined is that the DC potential profile varies abruptly across the ion guide in a radial direction from the first ion guide portion towards the second ion guide portion. As a result, ions which are close to the boundary region between the first and second ion guide portions may experience a very strong electric field which could undesirably cause the ions to become activated and/or fragmented. Conversely, ions which are further away from the boundary region may experience only a very weak electric field and hence may not be transferred from the first ion guide portion to the second ion guide portion.

It is therefore desired to provide an improved ion guide and method of guiding ions.

SUMMARY

According to an aspect there is provided an ion guide comprising:

a first ion guide portion comprising a first plurality of electrodes, wherein a first ion guiding path is formed along or within the first ion guide portion; and a second ion guide portion comprising a second plurality of electrodes, wherein a second different ion guiding path is formed along or within the second ion guide portion;

wherein the ion guide further comprises:

a first device arranged and adapted to apply a plurality of different first voltages or potentials to the first plurality of electrodes in order to generate an electric field which, in use, directs ions from the first ion guiding path into the second ion guiding path.

A known ion guide comprises a first ion guide portion and a second ion guide portion wherein all the electrodes forming the first ion guide portion are maintained at the same first DC voltage and all the electrodes forming the second ion guide portion are maintained at the same second DC voltage (which is different to that of the first DC voltage).

A problem with the known ion guide is that the resulting DC potential profile varies abruptly across the ion guide in a radial direction from the first ion guide portion towards the second ion guide portion. Thus, ions which are close to the boundary region between the first and second ion guide portions may experience a very strong electric field which could cause the ions to be undesirably activated and/or fragmented. Conversely, ions which are further away from the boundary region may experience only a very weak electric field and hence may not be transferred from the first ion guide portion to the second ion guide portion.

An important feature according to various embodiments is that a plurality of different first voltages or potentials may be applied to the (first) electrodes which form the first ion guide portion. As a result an electric field may be generated which has a greater field penetration into the first ion guide portion and/or wherein there is an (e.g. non-zero) electric field gradient or electric field profile across the first ion guide portion in a radial direction towards the second ion guide portion, which may be substantially linear, constant or smoother. Accordingly, ions which are close to the boundary region between the first and second ion guide portions can experience a relatively weaker electric field than in the known ion guide arrangement, and hence do not experience a very strong electric field which could otherwise cause the ions to be undesirably activated and/or fragmented. Likewise, ions which are further away from the boundary region can experience a relatively stronger electric field than in the known ion guide arrangement, and hence will be transferred from the first ion guide portion to the second ion guide portion (also without being actuated and/or fragmented).

It is apparent, therefore, that the ion guide according to various embodiments represents significant improvement compared to the known ion guide arrangement.

The first ion guiding path and the second ion guiding path may be substantially parallel to one another.

The plurality of different first voltages or potentials may comprise a plurality of different first DC voltages or potentials.

The plurality of different first voltages or potentials may comprise at least 2, 3, 4, 5, 6, 7, 8, 9, 10, 11, 12, 13, 14, 15, 16, 17, 18, 19 or 20 different first voltages or potentials.

The first device may be arranged and adapted to maintain a substantially constant, linear, regular or symmetric electric field gradient across at least 10%, 20%, 30%, 40%, 50%, 60%, 70%, 80%, 90% or 100% of the first ion guiding path in a direction substantially orthogonal to a longitudinal axis of the first ion guiding path. The electric field gradient may be non-zero.

The first device may be arranged and adapted to maintain an electric field across the first ion guiding path such that an electric field gradient across a portion of the first ion guiding path which is closest or proximal to the second ion guiding path in a direction substantially orthogonal to a longitudinal axis of the first ion guiding path is substantially the same as an electric field gradient across a portion of the first ion guiding path which is furthest or distal from the second ion guiding path in a direction substantially orthogonal to a longitudinal axis of the first ion guiding path.

The first device may be further arranged and adapted to maintain or create a potential difference between the first ion guide portion and the second ion guide portion.

The first device may be further arranged and adapted to apply one or more second voltages or potentials to the second plurality of electrodes.

The one or more second voltages or potentials may comprise a plurality of different second DC voltages or potentials The one or more second voltages or potentials may be substantially different to at least one, some or all of the first voltages or potentials.

The first device may further comprise a resistor chain.

The resistor chain may be interconnected between electrodes forming the first plurality of electrodes.

The first device may further comprise a plurality of voltage supplies.

Individual electrodes forming the first plurality of electrodes may be connected to separate voltage supplies.

The ion guide may further comprise a second device arranged and adapted to apply an AC or RF voltage to at least some or all of the first plurality of electrodes and/or to at least some or all of the second plurality of electrodes in order to constrain or confine ions radially within the first ion guide portion and/or the second ion guide portion.

The first plurality of electrodes may be selected from the group consisting of: (i) a plurality of ring or annular electrodes; (ii) a plurality of ring or annular electrodes having one or more radial cut-out portions; (iii) a plurality of electrodes having at least one aperture; (iv) a plurality of planar or stacked plate electrodes; (v) a plurality of planar or stacked plate electrodes having one or more radial cut-out portions; (vi) a plurality of key-hole or horse-shoe shaped electrodes; (vii) a plurality of rod electrodes; and (viii) a plurality of rod electrodes having one or more apertures.

The second plurality of electrodes may be selected from the group consisting of: (i) a plurality of ring or annular electrodes; (ii) a plurality of ring or annular electrodes having one or more radial cut-out portions; (iii) a plurality of electrodes having at least one aperture; (iv) a plurality of planar or stacked plate electrodes; (v) a plurality of planar or stacked plate electrodes having one or more radial cut-out portions; (vi) a plurality of key-hole or horse-shoe shaped electrodes; (vii) a plurality of rod electrodes; and (viii) a plurality of rod electrodes having one or more apertures.

The first plurality of electrodes may be arranged in planes substantially parallel to a first plane and the second plurality of electrodes may be arranged in planes substantially parallel to a second plane.

The first plane may be substantially parallel to the second plane. Alternatively, the first plane may be substantially orthogonal to the second plane.

The electric field may comprise a static DC electric field.

The electric field may comprise a transient DC electric field.

The first device may be arranged and adapted to apply one or more transient DC voltages or potentials to the first plurality of electrodes in order to direct ions from the first ion guiding path into the second ion guiding path.

The ion guide may further comprise a device which is arranged and adapted to apply one or more transient or static DC voltages or potentials to the first plurality of electrodes in order to urge ions axially or longitudinally along at least a portion of the first ion guiding path.

The ion guide may further comprise a device which is arranged and adapted to apply one or more transient or static DC voltages or potentials to the second plurality of electrodes in order to urge ions axially or longitudinally along at least a portion of the second ion guiding path.

According to various embodiments at least a portion of the first ion guiding path and at least a portion of the second ion guiding path are substantially parallel to one another.

The first ion guide portion may comprise an ion guiding region having a first cross-sectional area and the second ion guide portion may comprise an ion guiding region having a second cross-sectional area, wherein the first and second cross-sectional areas are substantially different.

The second cross-sectional area may be smaller or larger than the first cross-sectional area.

The first cross-sectional area may be at least 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, 550%, 600%, 650%, 700%, 750%, 800%, 850%, 900%, 950% or 1000% larger than the second cross-sectional area. Alternatively, the second cross-sectional area may be at least 5%, 10%, 15%, 20%, 25%, 30%, 35%, 40%, 45%, 50%, 55%, 60%, 65%, 70%, 75%, 80%, 85%, 90%, 95%, 100%, 150%, 200%, 250%, 300%, 350%, 400%, 450%, 500%, 550%, 600%, 650%, 700%, 750%, 800%, 850%, 900%, 950% or 1000% larger than the first cross-sectional area.

According to another aspect there is provided a mass spectrometer comprising an ion guide as described above.

According to another aspect there is provided a method of guiding ions comprising:

providing an ion guide, wherein the ion guide comprises:

(i) a first ion guide portion comprising a first plurality of electrodes, wherein a first ion guiding path is formed along or within the first ion guide portion; and (ii) a second ion guide portion comprising a second plurality of electrodes, wherein a second different ion guiding path is formed along or within the second ion guide portion;

wherein the method further comprises:

applying a plurality of different first voltages or potentials to the first plurality of electrodes in order to generate an electric field which directs ions from the first ion guiding path into the second ion guiding path.

The method of guiding ions may be performed using the ion guide and/or the mass spectrometer as described above. The method of guiding ions may comprise performing any one or more or all of the functional steps performed by the ion guide and/or the mass spectrometer as described above.

According to another aspect there is provided a method of mass spectrometry comprising a method of guiding ions as described above.

According to various embodiments an electric field may be generated which may extend and/or slope and/or move across the first ion guiding path towards the second ion guiding path and may extend and/or slope and/or move across some of, or the majority of, or substantially all of, the first ion guiding path.

Transferring the ions from the first ion guiding path to the second ion guiding path may further comprise maintaining or creating an electric field that extends and/or slopes and/or moves across the first ion guiding path towards the second ion guiding path in a direction that is substantially orthogonal to the first ion guiding path, wherein maintaining or creating the electric field comprises applying the first set of plural different voltages or potentials to the first plurality of electrodes of the first ion guide portion.

Transferring the ions from the first ion guiding path to the second ion guiding path may further comprise maintaining or creating a potential difference between the first ion guide portion and the second ion guide portion. Maintaining or creating the potential difference between the first ion guide portion and the second ion guide portion may comprise applying one or more voltages or potentials to the second plurality of electrodes of the second ion guide portion. The one or more voltages or potentials applied to the second plurality of electrodes of the second ion guide portion may be different to one or more of, or the majority of, or substantially all of, the first set of plural different voltages or potentials.

Transferring the ions from the first ion guiding path to the second ion guiding path may further comprise maintaining or creating an electric field that extends and/or slopes and/or moves across the second ion guiding path away from the first ion guiding path in a direction that is substantially orthogonal to the second ion guiding path, wherein maintaining or creating the electric field comprises applying a second set of plural different voltages or potentials to the second plurality of electrodes of the second ion guide portion.

The electric field may extend and/or slope and/or move across the second ion guiding path away from the first ion guiding path and may extend and/or move across some of, or the majority of, or substantially all of, the second ion guiding path.

The first device may further be arranged and adapted to transfer ions from the second ion guiding path to the first ion guiding path, for example in a different (e.g. previous or subsequent) mode of operation and/or at a different (e.g. upstream or downstream) axial or longitudinal position along the ion guide. Ions may be transferred (back and forth) between the first ion guide portion and the second ion guide portion multiple times or at least 2, 3, 4, 5, 6, 7, 8, 9 or 10 times.

Transferring ions from the second ion guiding path to the first ion guiding path may comprise maintaining or creating an electric field that extends and/or slopes and/or moves across the second ion guiding path towards the first ion guiding path in a direction that is substantially orthogonal to the second ion guiding path, wherein maintaining or creating the electric field comprises applying a third set of plural different voltages or potentials to the second plurality of electrodes of the second ion guide portion.

The electric field that extends and/or slopes and/or moves across the second ion guiding path towards the first ion guiding path may extend and/or slope and/or move across some of, or the majority of, or substantially all of, the second ion guiding path.

Transferring ions from the second ion guiding path to the first ion guiding path may further comprise maintaining or creating a potential difference between the second ion guide portion and the first ion guide portion. Maintaining or creating the potential difference between the second ion guide portion and the first ion guide portion may comprise applying one or more voltages or potentials to the first plurality of electrodes of the first ion guide portion. The one or more voltages or potentials applied to the first plurality of electrodes of the first ion guide portion may be different to one or more of, or the majority of, or substantially all of, the third set of plural different voltages or potentials.

Transferring the ions from the second ion guiding path to the first ion guiding path may further comprise maintaining or creating an electric field that extends and/or slopes and/or moves across the first ion guiding path away from the second ion guiding path in a direction that is substantially orthogonal to the first ion guiding path, wherein maintaining or creating the electric field comprises applying a fourth set of plural different voltages or potentials to the first plurality of electrodes of the first ion guide portion. The electric field that extends and/or slopes and/or moves across the first ion guiding path away from the second ion guiding path may extend and/or slope and/or move across some of, or the majority of, or substantially all of, the first ion guiding path.

The first set and/or second set and/or third set and/or fourth set of plural different voltages or potentials may each comprise a set of plural different DC voltages or potentials. The first set and/or second set and/or third set and/or fourth set of plural different voltages or potentials may each comprise a set of n different (DC) voltages or potentials, wherein n is at least 2, 3, 4, 5, 6, 7, 8, 9 or 10.

The first set and/or second set and/or third set and/or fourth set of plural different voltages or potentials may each comprise a set of plural different (DC) voltages or potentials that are respectively applied to plural different electrodes and/or electrode segments of the first ion guide portion or second ion guide portion. The plural different electrodes and/or electrode segments may be distributed along or have different positions with respect to the direction that is substantially orthogonal to the first ion guiding path and/or second ion guiding path. The plural different electrodes and/or electrode segments may be distributed across some of, or the majority of, or substantially all of, the first ion guide portion and/or second ion guide portion.

The first set and/or second set and/or third set and/or fourth set of plural different voltages or potentials may each comprise a set of plural different (DC) voltages or potentials that are provided by applying a first voltage or potential and a second different voltage or potential to respective ends of a resistor chain. The first voltage or potential, second voltage or potential, and/or one or more points between the plural resistors in the resistor chain may be electrically connected to respective electrodes and/or electrode segments of the first ion guide portion and/or second ion guide portion.

Alternatively, the first set and/or second set and/or third set and/or fourth set of plural different voltages or potentials may each comprise a set of plural different (DC) voltages or potentials provided by respective individual (e.g. individually controllable) voltage or potential sources. The individual voltage or potential sources may be electrically connected to respective electrodes and/or electrode segments of the first ion guide portion and/or second ion guide portion.

The first set and/or second set and/or third set and/or fourth set of plural different voltages or potentials may each comprise a set of plural different (DC) voltages or potentials that remain substantially static.

The first set and/or second set and/or third set and/or fourth set of plural different voltages or potentials may each comprise a set of plural different (DC) voltages or potentials that increase, decrease, vary, linearly increase, linearly decrease, increase in a stepped or other manner or decrease in a stepped or other manner in amplitude along the direction that is substantially orthogonal to the first ion guiding path and/or the second ion guiding path so as to transfer ions between the first ion guiding path and the second ion guiding path.

The first set and/or second set and/or third set and/or fourth set of plural different voltages or potentials may each comprise a set of plural different (DC) voltages or potentials that increase, decrease, vary, linearly increase, linearly decrease, increase in a stepped or other manner or decrease in a stepped or other manner in amplitude across some of, or the majority of, or substantially all of, the first ion guide portion and/or second ion guide portion so as to transfer ions between the first ion guiding path and the second ion guiding path.

The first set and/or second set and/or third set and/or fourth set of plural different voltages or potentials may each comprise a set of plural different (DC) voltages or potentials that are substantially transient and/or that provide a moving or travelling voltage or potential waveform (e.g. a "T-wave").

The first set and/or second set and/or third set and/or fourth set of plural different voltages or potentials may each comprise a set of plural different (DC) voltages or potentials that (collectively) move or travel and/or that are (collectively) progressively applied along the direction that is substantially orthogonal to the first ion guiding path and/or the second ion guiding path so as to transfer (e.g. drive, urge or sweep) ions between the first ion guiding path and the second ion guiding path.

The first set and/or second set and/or third set and/or fourth set of plural different voltages or potentials may each comprise a set of plural different (DC) voltages or potentials that (collectively) move or travel and/or that are (collectively) progressively applied across some of, or the majority of, or substantially all of, the first ion guide portion and/or second ion guide portion so as to transfer (e.g. drive, urge or sweep) ions between the first ion guiding path and the second ion guiding path.

The first set and/or second set and/or third set and/or fourth set of plural different voltages or potentials may each comprise a set of plural different (DC) voltages or potentials that collectively or individually increase, decrease, vary, linearly increase, linearly decrease, increase in a stepped or other manner or decrease in a stepped or other manner in amplitude over time.

In embodiments, the first set and/or second set and/or third set and/or fourth set of plural different voltages or potentials may provide for a controlled transfer of ions between the first ion guiding path and the second ion guiding path. The first set and/or second set and/or third set and/or fourth set of plural different voltages or potentials may also or instead reduce or avoid the incidence of some ions not being suitably transferred between the first ion guiding path and the second ion guiding path.

Adjacent or neighbouring electrodes and/or electrode segments of the first ion guide portion and/or second ion guide portion may be maintained at opposite phases of an AC or RF voltage so as confine or constrain the ions within the first ion guide portion and/or the second ion guide portion.

The first plurality of electrodes and/or the second plurality of electrodes may comprise ring electrodes. The ring electrodes may be circumferentially segmented ring electrodes. In these embodiments, the first set and/or second set and/or third set and/or fourth set of plural different voltages or potentials may each comprise a set of plural different (DC) voltages or potentials that are respectively applied to different ring electrode segments of the first ion guide portion and/or second ion guide portion, for example in the manner discussed above. Adjacent or neighbouring ring electrodes and/or ring electrode segments may be maintained at opposite phases of an AC or RF voltage, for example in the manner discussed above. The ring electrodes may each comprise at least one aperture through which ions are transmitted in use.

Optionally either:

(a) at least 1%, 5%, 10%, 20%, 30%, 40%, 50%, 60%, 70%, 80%, 90%, 95% or 100% of the first plurality of electrodes and/or the second plurality of electrodes have substantially circular, rectangular, square or elliptical apertures; and/or (b) at least 1%, 5%, 10%, 20%, 30%, 40%, 50%, 60%, 70%, 80%, 90%, 95% or 100% of the first plurality of electrodes and/or the second plurality of electrodes have apertures which are substantially the same size or which have substantially the same area; and/or (c) at least 1%, 5%, 10%, 20%, 30%, 40%, 50%, 60%, 70%, 80%, 90%, 95% or 100% of the first plurality of electrodes and/or the second plurality of electrodes have apertures which become progressively larger and/or smaller in size or in area in a direction along the axis or length of the first ion guide portion and/or the second ion guide portion; and/or (d) at least 1%, 5%, 10%, 20%, 30%, 40%, 50%, 60%, 70%, 80%, 90%, 95% or 100% of the first plurality of electrodes and/or the second plurality of electrodes have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm; and/or (e) at least 1%, 5%, 10%, 20%, 30%, 40%, 50%, 60%, 70%, 80%, 90%, 95% or 100% of the first plurality of electrodes and/or the second plurality of electrodes are spaced apart from one another by an axial or longitudinal distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (f) at least at least 1%, 5%, 10%, 20%, 30%, 40%, 50%, 60%, 70%, 80%, 90%, 95% or 100% of the first plurality of electrodes and/or the second plurality of electrodes comprise apertures wherein the ratio of the internal diameter or dimension of the apertures to the centre-to-centre axial or longitudinal spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; and/or (g) at least 1%, 5%, 10%, 20%, 30%, 40%, 50%, 60%, 70%, 80%, 90%, 95% or 100% of the first plurality of electrodes and/or the second plurality of electrodes have a thickness or axial or longitudinal length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (h) the first plurality of electrodes have a first cross-sectional area or profile, wherein the first cross-sectional area or profile changes, increases, decreases or varies along at least at least 1%, 5%, 10%, 20%, 30%, 40%, 50%, 60%, 70%, 80%, 90%, 95% or 100% of the length of the first ion guide portion; and/or (i) the second plurality of electrodes have a second cross-sectional area or profile, wherein the second cross-sectional area or profile changes, increases, decreases or varies along at least at least 1%, 5%, 10%, 20%, 30%, 40%, 50%, 60%, 70%, 80%, 90%, 95% or 100% of the length of the second ion guide portion.

The first plurality of electrodes and/or the second plurality of electrodes may also or instead comprise rod electrodes. In these embodiments, the first set and/or second set and/or third set and/or fourth set of plural different voltages or potentials may each comprise a set of plural different (DC) voltages or potentials that are respectively applied to different rod electrodes of the first ion guide portion and/or second ion guide portion, for example in the manner discussed above. The rod electrodes may be axially or longitudinally segmented rod electrodes. Adjacent or neighbouring rod electrodes and/or rod electrode segments may be maintained at opposite phase of an AC or RF voltage, for example in the manner discussed above. The rod electrodes may substantially surround or form at least one ion guiding path through which ions are transmitted in use.

Optionally:

(a) the first ion guide portion and/or the second ion guide portion comprise one or more axially or longitudinally segmented rod sets; and/or (b) the first ion guide portion and/or the second ion guide portion comprise one or more segmented quadrupole, hexapole or octapole rod sets or comprise four or more segmented rod sets; and/or (c) the first ion guide portion and/or the second ion guide portion comprise a plurality of electrodes having a cross-section selected from the group consisting of: (i) an approximately or substantially circular cross-section; (ii) an approximately or substantially hyperbolic surface; (iii) an arcuate or part-circular cross-section; (iv) an approximately or substantially rectangular cross-section; and (v) an approximately or substantially square cross-section; and/or (d) the first ion guide portion and/or the second ion guide portion comprise a plurality of ring electrodes arranged around one or more first rod sets and/or one or more second rod sets; and/or (e) the first ion guide portion and/or the second ion guide portion comprise 4, 5, 6, 7, 8, 9, 10, 11, 12, 13, 14, 15, 16, 17, 18, 19, 20, 21, 22, 23, 24, 25, 26, 27, 28, 29, 30 or >30 rod electrodes.

The first plurality of electrodes and/or the second plurality of electrodes may also or instead comprise stacked electrodes arranged generally in planes parallel to an axial or longitudinal direction in which ions travel in use. In these embodiments, the first set and/or second set and/or third set and/or fourth set of plural different voltages or potentials may each comprise a set of plural different (DC) voltages or potentials that are respectively applied to different stacked electrodes of the first ion guide portion and/or second ion guide portion, for example in the manner discussed above. The stacked electrodes may be axially or longitudinally segmented stacked electrodes. Adjacent or neighbouring stacked electrodes and/or stacked electrode segments may be maintained at opposite phase of an AC or RF voltage, for example in the manner discussed above. The stacked electrodes may substantially surround or form at least one ion guiding path through which ions are transmitted in use.

Optionally:

(a) the first ion guide portion and/or the second ion guide portion comprises a stack or array of planar, plate, mesh or curved stacked electrodes, wherein the stack or array of planar, plate, mesh or curved stacked electrodes comprises a plurality or at least 2, 3, 4, 5, 6, 7, 8, 9, 10, 11, 12, 13, 14, 15, 16, 17, 18, 19 or 20 planar, plate, mesh or curved stacked electrodes and wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the planar, plate, mesh or curved stacked electrodes are arranged generally in planes parallel to an axial or longitudinal direction in which ions travel in use; and/or (b) the first ion guide portion and/or the second ion guide portion are axially or longitudinally segmented so as to comprise at least 2, 3, 4, 5, 6, 7, 8, 9, 10, 11, 12, 13, 14, 15, 16, 17, 18, 19 or 20 axial or longitudinal segments.

The first device may be arranged and adapted:

(a) to transfer ions radially between the first ion guiding path and the second ion guiding path; and/or (b) to transfer ions with a non-zero radial component of velocity and an axial or longitudinal component of velocity between the first ion guiding path and the second ion guiding path; and/or (c) to transfer ions with a non-zero radial component of velocity and an axial or longitudinal component of velocity between the first ion guiding path and the second ion guiding path, wherein the ratio of the radial component of velocity to the axial or longitudinal component of velocity is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-3.0; (xxii) 3.0-4.0; (xxiii) 4.0-5.0; (xxiv) 5.0-6.0; (xxv) 6.0-7.0; (xxvi) 7.0-8.0; (xxvii) 8.0-9.0; (xxviii) 9.0-10.0; and (xxix) >10.0;

(d) to transfer ions between the first ion guiding path and the second ion guiding path by transferring ions across one or more radial pseudo-potential barriers arranged between the first ion guiding path and the second ion guiding path.

Ions may be transferred between the two ion guide portions in a manner which is different to transferring ions between two ion guide portions arranged in series. With two ion guide portions arranged in series ions are not transferred radially as in embodiments.

The ion guide may further comprise a second device arranged and adapted to create one or more pseudo-potential barriers at one or more points along the length of the ion guide between the first ion guiding path and the second ion guiding path. Ions may be transferred radially or with a non-zero radial component of velocity across one or more radial pseudo-potential barriers disposed between the first ion guide portion and the second ion guide portion.

Again, ions may be transferred between the two ion guide portions in a manner which is different to transferring ions between two ion guide portions arranged in series. With two ion guide portions arranged in series ions are not transferred across a radial pseudo-potential barrier as in embodiments.

The second device may be arranged and adapted to create:

(i) one or more radial pseudo-potential barriers at one or more points along the length of the ion guide between the first ion guiding path and the second ion guiding path; and/or (ii) one or more non-axial or non-longitudinal pseudo-potential barriers at one or more points along the length of the ion guide between the first ion guiding path and the second ion guiding path.

The first ion guide portion and the second ion guide portion may be conjoined, merged, overlapped or open to one another.

Optionally:

(a) the first ion guide portion and the second ion guide portion are conjoined, 50%, 60%, 70%, 80%, 90%, 95% or 100% of the length of the first ion guide portion and/or the second ion guide portion; and/or (b) ions may be transferred radially between the first ion guide portion or the first ion guiding path and the second ion guide portion or the second ion guiding path over at least 1%, 5%, 10%, 20%, 30%, 40%, 50%, 60%, 70%, 80%, 90%, 95% or 100% of the length of the first ion guide portion and/or the second ion guide portion; and/or (c) one or more radial pseudo-potential barriers are formed, in use, which separate the first ion guide portion or the first ion guiding path from the second ion guide portion or the second ion guiding path along at least 1%, 5%, 10%, 20%, 30%, 40%, 50%, 60%, 70%, 80%, 90%, 95% or 100% of the length of the first ion guide portion and/or the second ion guide portion; and/or (d) a first pseudo-potential valley or field is formed within the first ion guide portion and a second pseudo-potential valley or field is formed within the second ion guide portion and wherein a pseudo-potential barrier separates the first pseudo-potential valley from the second pseudo-potential valley, wherein ions are confined radially within the ion guide by either the first pseudo-potential valley or the second pseudo-potential valley and wherein at least some ions are urged or caused to transfer across the pseudo-potential barrier; and/or (e) the degree of overlap or openness between the first ion guide portion and the second ion guide portion remains constant or varies, increases, decreases, increases in a stepped or linear manner or decreases in a stepped or linear manner along the length of the first and second ion guide portions.

Optionally:

(a) the first set and/or second set and/or third set and/or fourth set of plural voltages or potentials each comprises a set of plural different (DC) voltages or potentials, wherein the plural different (DC) voltages or potentials of the set are selected from the group consisting of: (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V; (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix) >±1000 V; and/or (b) the potential difference between the first ion guide portion and the second ion guide portion and/or between the second ion guide portion and the first ion guide portion is selected from the group consisting of: (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-150 V; (xii) ±150-200 V; (xiii) ±200-250 V; (xiv) ±250-300 V; (xv) ±300-350 V; (xvi) ±350-400 V; (xvii) ±400-450 V; (xviii) ±450-500 V; (xix) ±500-550 V; (xx) ±550-600 V; (xxi) ±600-650 V; (xxii) ±650-700 V; (xxiii) ±700-750 V; (xxiv) ±750-800 V; (xxv) ±800-850 V; (xxvi) ±850-900 V; (xxvii) ±900-950 V; (xxviii) ±950-1000 V; and (xxix) >±1000 V.

The first ion guiding path and the second ion guiding path may be substantially parallel to one another. The first ion guide portion may comprise a first central longitudinal axis and the second ion guide portion may comprise a second central longitudinal axis wherein optionally:

(i) the first central longitudinal axis is substantially parallel with the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (ii) the first central longitudinal axis is not co-linear or co-axial with the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (iii) the first central longitudinal axis is spaced at a constant distance or remains equidistant from the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (iv) the first central longitudinal axis is a mirror image of the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (v) the first central longitudinal axis substantially tracks, follows, mirrors or runs parallel to and/or alongside the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (vi) the first central longitudinal axis converges towards or diverges away from the second central longitudinal axis for at least 1%, 5%, 10%, 20%, 30%, 40%, 50%, 60%, 70%, 80%, 90%, 95% or 100% of the length of the first ion guide portion and/or the second ion guide portion; and/or (vii) the first central longitudinal axis and the second central longitudinal axis form a X-shaped or Y-shaped coupler or splitter ion guiding path; and/or (viii) one or more crossover regions, sections or junctions are arranged between the first ion guide portion and the second ion guide portion wherein at least some ions may be transferred or are caused to be transferred between the first ion guide portion and the second ion guide portion.

In use a first pseudo-potential valley may be formed within the first ion guide portion such that the first pseudo-potential valley has a first longitudinal axis and likewise in use a second pseudo-potential valley may be formed within the second ion guide portion such that the second pseudo-potential valley has a second longitudinal axis, wherein optionally:

(i) the first longitudinal axis is substantially parallel with the second longitudinal axis for at least 1%, 5%, 10%, 20%, 30%, 40%, 50%, 60%, 70%, 80%, 90%, 95% or 100% of the length of the first ion guide portion and/or the second ion guide portion; and/or (ii) the first longitudinal axis is not co-linear or co-axial with the second longitudinal axis for at least 1%, 5%, 10%, 20%, 30%, 40%, 50%, 60%, 70%, 80%, 90%, 95% or 100% of the length of the first ion guide portion and/or the second ion guide portion; and/or (iii) the first longitudinal axis is spaced at a constant distance or remains equidistant from the second longitudinal axis for at least 1%, 5%, 10%, 20%, 30%, 40%, 50%, 60%, 70%, 80%, 90%, 95% or 100% of the length of the first ion guide portion and/or the second ion guide portion; and/or (iv) the first longitudinal axis is a mirror image of the second longitudinal axis for at least 1%, 5%, 10%, 20%, 30%, 40%, 50%, 60%, 70%, 80%, 90%, 95% A or 100% of the length of the first ion guide portion and/or the second ion guide portion; and/or (v) the first longitudinal axis substantially tracks, follows, mirrors or runs parallel to and/or alongside the second longitudinal axis for at least 1%, 5%, 10%, 20%, 30%, 40%, 50%, 60%, 70%, 80%, 90%, 95% or 100% of the length of the first ion guide portion and/or the second ion guide portion; and/or (vi) the first longitudinal axis converges towards or diverges away from the second longitudinal axis for at least 1%, 5%, 10%, 20%, 30%, 40%, 50%, 60%, 70%, 80%, 90%, 95% or 100% of the length of the first ion guide portion and/or the second ion guide portion; and/or (vii) the first longitudinal axis and the second longitudinal form a X-shaped or Y-shaped coupler or splitter ion guiding path; and/or (viii) one or more crossover regions, sections or junctions are arranged between the first ion guide portion and the second ion guide portion wherein at least some ions may be transferred or are caused to be transferred from the first ion guide portion into the second ion guide portion and/or wherein at least some ions may be transferred from the second ion guide portion into the first ion guide portion.

Optionally:

(a) the first ion guide portion comprises an ion guiding region having a first cross-sectional area and the second ion guide portion comprises an ion guiding region having a second cross-sectional area, wherein the first and second cross-sectional areas are substantially the same or substantially different; and/or (b) the first ion guide portion comprises an ion guiding region having a first cross-sectional area and the second ion guide portion comprises an ion guiding region having a second cross-sectional area, wherein the ratio of the first cross-sectional area to the second cross-sectional area is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1.0-1.1; (xii) 1.1-1.2; (xiii) 1.2-1.3; (xiv) 1.3-1.4; (xv) 1.4-1.5; (xvi) 1.5-1.6; (xvii) 1.6-1.7; (xviii) 1.7-1.8; (xix) 1.8-1.9; (xx) 1.9-2.0; (xxi) 2.0-2.5; (xxii) 2.5-3.0; (xxiii) 3.0-3.5; (xxiv) 3.5-4.0; (xxv) 4.0-4.5; (xxvi) 4.5-5.0; (xxvii) 5.0-6.0; (xxviii) 6.0-7.0; (xxix) 7.0-8.0; (xxx) 8.0-9.0; (xxxi) 9.0-10.0; and (xxxii) >10.0; and/or (c) the first ion guide portion comprises an ion guiding region having a first cross-sectional area or profile, and wherein the first cross-sectional area or profile changes, increases, decreases or varies along at least at least 1%, 5%, 10%, 20%, 30%, 40%, 50%, 60%, 70%, 80%, 90%, 95% or 100% of the length of the first ion guide portion; and/or (d) the second ion guide portion comprises an ion guiding region having a second cross-sectional area or profile, and wherein the second cross-sectional area or profile changes, increases, decreases or varies along at least at least 1%, 5%, 10%, 20%, 30%, 40%, 50%, 60%, 70%, 80%, 90%, 95% or 100% of the length of the second ion guide portion; and/or (e) the first ion guide portion comprises a plurality of axial or longitudinal sections and wherein the cross-sectional area or profile of first electrodes in an axial or longitudinal section is substantially the same or different and wherein the cross-sectional area or profile of first electrodes in further axial or longitudinal sections is substantially the same or different; and/or (f) the second ion guide portion comprises a plurality of axial or longitudinal sections and wherein the cross-sectional area or profile of second electrodes in an axial or longitudinal section is substantially the same or different and wherein the cross-sectional area or profile of second electrodes in further axial or longitudinal sections is substantially the same or different; and/or (g) the first ion guide portion and/or the second ion guide portion comprise a substantially constant or uniform cross-sectional area or profile.

The first ion guide portion and/or the second ion guide portion may comprise:

(i) a first axial or longitudinal segment wherein the first ion guide portion and/or the second ion guide portion comprise a first cross-sectional area or profile; and/or (ii) a second different axial or longitudinal segment wherein the first ion guide portion and/or the second ion guide portion comprise a second cross-sectional area or profile; and/or (iii) a third different axial or longitudinal segment wherein the first ion guide portion and/or the second ion guide portion comprise a third cross-sectional area or profile; and/or (iv) a fourth different axial or longitudinal segment wherein the first ion guide portion and/or the second ion guide portion comprise a fourth cross-sectional area or profile;

wherein optionally the first, second, third and fourth cross-sectional area or profiles are substantially the same or different.

The ion guide may be arranged and adapted so as to form:

(i) a linear ion guide portion or ion guide; and/or (ii) an open-loop ion guide portion or ion guide; and/or (iii) a closed-loop ion guide portion or ion guide; and/or (iv) a helical, toroidal, part-toroidal, hemitoroidal, semi-toroidal or spiral ion guide portion or ion guide; and/or (v) an ion guide portion or ion guide having a curved, labyrinthine, tortuous, serpentine, circular or convoluted ion guide portion or ion guiding path.

The first ion guide portion and/or the second ion guide portion may comprise n axial or longitudinal segments or may be segmented into n separate axial or longitudinal segments, wherein n is selected from the group consisting of: (i) 1-10; (ii) 11-20; (iii) 21-30; (iv) 31-40; (v) 41-50; (vi) 51-60; (vii) 61-70; (viii) 71-80; (ix) 81-90; (x) 91-100; and (xi) >100;

and wherein optionally:

(a) each axial or longitudinal segment comprises 1, 2, 3, 4, 5, 6, 7, 8, 9, 10, 11, 12, 13, 14, 15, 16, 17, 18, 19, 20 or >20 electrodes; and/or (b) the axial or longitudinal length of at least 1%, 5%, 10%, 20%, 30%, 40%, 50%, 60%, 70%, 80%, 90%, 95% or 100% of the axial or longitudinal segments is selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (c) the axial or longitudinal spacing between at least 1%, 5%, 10%, 20%, 30%, 40%, 50%, 60%, 70%, 80%, 90%, 95% or 100% of the axial or longitudinal segments is selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The first ion guide portion and/or the second ion guide portion may:

(a) have a length selected from the group consisting of: (i) <20 mm; (ii) 20-40 mm; (iii) 40-60 mm; (iv) 60-80 mm; (v)

80-100 mm; (vi) 100-120 mm; (vii) 120-140 mm; (viii) 140-160 mm; (ix) 160-180 mm; (x) 180-200 mm; and (xi) >200 mm; and/or (b) comprise at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guide may further comprise a first AC or RF voltage supply for applying a first AC or RF voltage to at least some of the first plurality of electrodes and/or the second plurality of electrodes, wherein optionally either:

(a) the first AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) the first AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (c) the first AC or RF voltage supply is arranged to apply the first AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the first plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the first plurality of electrodes; and/or (d) the first AC or RF voltage supply is arranged to apply the first AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the second plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the second plurality of electrodes; and/or (e) the first AC or RF voltage supply is arranged to supply adjacent or neighbouring electrodes and/or electrode segments of the first plurality of electrodes with opposite phases of the first AC or RF voltage; and/or (f) the first AC or RF voltage supply is arranged to supply adjacent or neighbouring electrodes and/or electrode segments of the second plurality of electrodes with opposite phases of the first AC or RF voltage; and/or (g) the first AC or RF voltage generates one or more radial pseudo-potential wells which act to confine ions radially within the first ion guide portion and/or the second ion guide portion.

Optionally, the ion guide may further comprise a third device arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage by $x_1$ Volts over a time period $t_1$, wherein optionally:

(a) $x_1$ is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) $t_1$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

Optionally, one or more first axial or longitudinal time averaged or pseudo-potential barriers, corrugations or wells may be created, in use, along at least 1%, 5%, 10%, 20%, 30%, 40%, 50%, 60%, 70%, 80%, 90% or 95% of the axial or longitudinal length of the first ion guide portion.

The ion guide may further comprise a second AC or RF voltage supply for applying a second AC or RF voltage to at least some of the first plurality of electrodes and/or the second plurality of electrodes, wherein optionally either:

(a) the second AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) the second AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and/or (c) the second AC or RF voltage supply is arranged to apply the second AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the first plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the first plurality of electrodes; and/or (d) the first AC or RF voltage supply is arranged to apply the second AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the second plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the second plurality of electrodes; and/or (e) the second AC or RF voltage supply is arranged to supply adjacent or neighbouring electrodes and/or electrode segments of the first plurality of electrodes with opposite phases of the second AC or RF voltage; and/or (f) the second AC or RE voltage supply is arranged to supply adjacent or neighbouring electrodes and/or electrode segments of the second plurality of electrodes with opposite phases of the second AC or RF voltage; and/or (g) the second AC or RF voltage generates one or more radial pseudo-potential wells which act to confine ions radially within the first ion guide portion and/or the second ion guide portion.

The ion guide may further comprise a fourth device arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage by $x_2$ Volts over a time period $t_2$, wherein optionally:

(a) $x_2$ is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak; and/or (b) $t_2$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

Optionally, one or more second axial or longitudinal time averaged or pseudo-potential barriers, corrugations or wells may be created, in use, along at least 1%, 5%, 10%, 20%, 30%, 40%, 50%, 60%, 70%, 80%, 90% or 95% of the axial or longitudinal length of the second ion guide portion.

A non-zero axial or longitudinal DC voltage gradient may be maintained in use along one or more sections or portions of the first ion guide portion and/or the second ion guide portion.

Optionally, the ion guide may further comprise a device for driving or urging ions upstream and/or downstream along or around at least 1%, 5%, 10%, 20%, 30%, 40%, 50%, 60%, 70%, 80%, 90%, 95% or 100% of the length or ion guiding path of the first ion guide portion and/or the second ion guide portion, wherein the device optionally comprises:

(i) a device for applying one more transient DC voltages or potentials or DC voltage or potential waveforms to at least 1%, 5%, 10%, 20%, 30%, 40%, 50%, 60%, 70%, 80%, 90%, 95% or 100% of the first plurality of electrodes and/or the second plurality of electrodes in order to urge at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial or longitudinal length of the first ion guide portion and/or the second ion guide portion; and/or (ii) a device arranged and adapted to apply two or more phase-shifted AC or RF voltages to electrodes forming the first ion guide portion and/or the second ion guide portion in order to urge at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial or longitudinal length of the first ion guide portion and/or the second ion guide portion; and/or (iii) a device arranged and adapted to apply one or more DC voltages to electrodes forming the first ion guide portion and/or the second ion guide portion in order create or form an axial or longitudinal DC voltage gradient which has the effect of urging or driving at least some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial or longitudinal length of the first ion guide portion and/or the second ion guide portion.

The ion guide may further comprise a fifth device arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or DC voltage or potential waveforms by $x_3$ Volts over a time period $t_3$;

wherein $x_3$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V; and/or wherein $t_3$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The ion guide may further comprise a sixth device arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or DC voltage or potential waveforms are applied to the electrodes by $x_4$ m/s over a time period $t_4$;

wherein $x_4$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii)

17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; and (xxxvii) >500; and/or wherein $t_4$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

Optionally, the ion guide may further comprise a device arranged to maintain a substantially constant non-zero DC voltage gradient along at least 1%, 5%, 10%, 20%, 30%, 40%, 50%, 60%, 70%, 80%, 90%, 95% or 100% of the length or ion guiding path of the first ion guide portion and/or the second ion guide portion.

The second device may be arranged and adapted to mass selectively or mass to charge ratio selectively transfer ions from the first ion guiding path (or first ion guide portion) into the second ion guiding path (or second ion guide portion) and/or from the second ion guiding path (or second ion guide portion) into the first ion guiding path (or first ion guide portion).

A parameter affecting the mass selective or mass to charge ratio selective transfer of ions from the first ion guiding path (or first ion guide portion) into the second ion guiding path (or second ion guide portion) and/or from the second ion guiding path (or second ion guide portion) into the first ion guiding path (or first ion guide portion) may be progressively increased, progressively decreased, progressively varied, scanned, linearly increased, linearly decreased, increased in a stepped, progressive or other manner or decreased in a stepped, progressive or other manner. The parameter may be selected from the group consisting of:

(i) an axial or longitudinal DC voltage gradient maintained, in use, along or between one or more sections or portions of the first ion guide portion and/or the second ion guide portion; and/or (ii) one or more AC or RF voltages applied to at least some or substantially all of the first plurality of electrodes and/or the second plurality of electrodes.

The first ion guide portion and/or the second ion guide portion may be arranged and adapted to receive a beam or group of ions and to convert or partition the beam or group of ions such that at least 1, 2, 3, 4, 5, 6, 7, 8, 9, 10, 11, 12, 13, 14, 15, 16, 17, 18, 19 or 20 separate packets of ions are confined and/or isolated within the first ion guide portion and/or the second ion guide portion at any particular time, and wherein each packet of ions is separately confined and/or isolated in a separate axial or longitudinal potential well formed in the first ion guide portion and/or the second ion guide portion.

Optionally:

(a) one or more portions of the first ion guide portion and/or the second ion guide portion may comprise an ion mobility spectrometer or separator portion, section or stage wherein ions are caused to separate temporally according to their ion mobility in the ion mobility spectrometer or separator portion, section or stage; and/or (b) one or more portions of the first ion guide portion and/or the second ion guide portion may comprise a Field Asymmetric Ion Mobility Spectrometer ("FAIMS") portion, section or stage wherein ions are caused to separate temporally according to their rate of change of ion mobility with electric field strength in the Field Asymmetric Ion Mobility Spectrometer ("FAIMS") portion, section or stage; and/or (c) in use a buffer gas is provided within one or more sections of the first ion guide portion and/or the second ion guide portion; and/or (d) in a mode of operation ions may be arranged to be collisionally cooled without fragmenting upon interaction with gas molecules within a portion or region of the first ion guide portion and/or the second ion guide portion; and/or (e) in a mode of operation ions are arranged to be heated upon interaction with gas molecules within a portion or region of the first ion guide portion and/or the second ion guide portion; and/or (f) in a mode of operation ions are arranged to be fragmented upon interaction with gas molecules within a portion or region of the first ion guide portion and/or the second ion guide portion; and/or (g) in a mode of operation ions are arranged to unfold or at least partially unfold upon interaction with gas molecules within the first ion guide portion and/or the second ion guide portion; and/or (h) ions are trapped axially or longitudinally within a portion or region of the first ion guide portion and/or the second ion guide portion.

The first ion guide portion and/or the second ion guide portion may further comprise a collision, fragmentation or reaction device, wherein in a mode of operation ions are arranged to be fragmented within the first ion guide portion and/or the second ion guide portion by: (i) Collisional Induced Dissociation ("CID"); (ii) Surface Induced Dissociation ("SID"); (iii) Electron Transfer Dissociation ("ETD"); (iv) Electron Capture Dissociation ("ECD"); (v) Electron Collision or Impact Dissociation; (vi) Photo Induced Dissociation ("PID"); (vii) Laser Induced Dissociation; (viii) infrared radiation induced dissociation; (ix) ultraviolet radiation induced dissociation; (x) thermal or temperature dissociation; (xi) electric field induced dissociation; (xii) magnetic field induced dissociation; (xiii) enzyme digestion or enzyme degradation dissociation; (xiv) ion-ion reaction dissociation; (xv) ion-molecule reaction dissociation; (xvi) ion-atom reaction dissociation; (xvii) ion-metastable ion reaction dissociation; (xviii) ion-metastable molecule reaction dissociation; (xix) ion-metastable atom reaction dissociation; and (xx) Electron Ionisation Dissociation ("EID").

Optionally, the ion guide may further comprise a device for injecting ions into the first ion guide portion and/or the second ion guide portion.

Optionally, the ion guide may further comprise a device for ejecting ions from the first and/or second ion guide portion.

Optionally, the ion guide may further comprise:

(a) a device for maintaining in a mode of operation at least a portion of the first ion guide portion and/or the second ion guide portion at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-4}$-$10^{-3}$ mbar; (x) $10^{-3}$-$10^{-2}$ mbar; and (xi) $10^{-2}$-$10^{-1}$ mbar; and/or (b) a device for maintaining in a mode of operation at least a length L of the first ion guide portion and/or a second ion guide portion at a pressure P wherein the product P×L is selected from the group consisting of: (i) $\geq1.0\times10^{-3}$ mbar cm; (ii) $\geq1.0\times10^{-2}$ mbar cm; (iii) $\geq1.0\times10^{-1}$ mbar cm;

(iv) ≥1 mbar cm; (v) ≥10 mbar cm; (vi) ≥$10^2$ mbar cm; (vii) ≥$10^3$ mbar cm; (viii) ≥$10^4$ mbar cm; and (ix) ≥$10^5$ mbar cm; and/or (c) a device for maintaining in a mode of operation the first ion guide portion and/or the second ion guide portion at a pressure selected from the group consisting of: (i) >100 mbar; (ii) >10 mbar; (iii) >1 mbar; (iv) >0.1 mbar; (v) >$10^{-2}$ mbar; (vi) >$10^{-3}$ mbar; (vii) >$10^{-4}$ mbar; (viii) >$10^{-5}$ mbar; (ix) >$10^{-6}$ mbar; (x) <100 mbar; (xi) <10 mbar; (xii) <1 mbar; (xiii) <0.1 mbar; (xiv) <$10^{-2}$ mbar; (xv) <$10^{-3}$ mbar; (xvi) <$10^{-4}$ mbar; (xvii) <$10^{-5}$ mbar; (xviii) <$10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to embodiments the ion guide may comprise two or more parallel conjoined ion guide portions.

The first ion guide portion and/or the second ion guide portion may be selected from the group consisting of:

(i) an ion tunnel ion guide portion comprising a plurality of electrodes having at least one aperture through which ions are transmitted in use; and/or (ii) a rod set ion guide portion comprising a plurality of rod electrodes; and/or (iii) a stacked plate ion guide portion comprising a plurality of plate electrodes arranged generally in planes parallel to an axial or longitudinal direction in which ions travel in use.

The ion guide may comprise a hybrid arrangement wherein, for example, the first ion guide portion comprises a rod set or stacked plate ion guide portion and the second ion guide portion comprises an ion tunnel or ring electrode set ion guide portion.

According to another aspect and various embodiments there is provided an ion guide comprising:

a first ion guide portion comprising a first plurality of electrodes, wherein a first ion guiding path is formed along or within the first ion guide portion;

a second ion guide portion comprising a second plurality of electrodes, wherein a second different ion guiding path is formed along or within the second ion guide portion; and a device arranged and adapted to transfer ions from the first ion guiding path to the second ion guiding path, wherein transferring the ions from the first ion guiding path to the second ion guiding path comprises maintaining or creating an electric field that extends and/or slopes and/or moves across the first ion guiding path towards the second ion guiding path in a direction that is substantially orthogonal to the first ion guiding path, wherein maintaining or creating the electric field comprises applying a first set of plural different voltages or potentials to the first plurality of electrodes of the first ion guide portion.

According to another aspect and various embodiments there is provided an ion guide arranged and adapted to provide an electric field orthogonal to the ion transport direction to move ions from one portion of the ion guide to another, wherein the electric field is generated using more than two voltages.

According to another aspect there is provided a mass spectrometer comprising an ion guide as described above.

According to another aspect and various embodiments there is provided a method of guiding ions comprising:

providing an ion guide, wherein the ion guide comprises:

(i) a first ion guide portion comprising a first plurality of electrodes, wherein a first ion guiding path is formed along or within the first ion guide portion; and (i) a second ion guide portion comprising a second plurality of electrodes, wherein a second different ion guiding path is formed along or within the second ion guide portion;

wherein the method further comprises:

transferring ions from the first ion guiding path to the second ion guiding path, wherein transferring the ions from the first ion guiding path to the second ion guiding path comprises maintaining or creating an electric field that extends and/or slopes and/or moves across the first ion guiding path towards the second ion guiding path in a direction that is substantially orthogonal to the first ion guiding path, wherein maintaining or creating the electric field comprises applying a first set of plural different voltages or potentials to the first plurality of electrodes of the first ion guide portion.

The method of guiding ions may be performed using the ion guide and/or the mass spectrometer as described above. The method of guiding ions may comprise performing any one or more or all of the functional steps performed by the ion guide and/or the mass spectrometer as described above.

According to another aspect or embodiments there is provided a method of guiding ions comprising providing an electric field orthogonal to the ion transport direction to move ions from one portion of an ion guide to another, wherein the electric field is generated using more than two voltages.

According to another aspect there is provided a method of mass spectrometry comprising a method of guiding ions as described above.

The mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The mass spectrometer may further comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. The chromatography separation device may comprise a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

One or more of the ion guides may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

The analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

In order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

In order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The mass spectrometer may be operated in various modes of operation including a mass spectrometry ("MS") mode of operation, a tandem mass spectrometry ("MS/MS") mode of operation, a mode of operation in which parent or precursor ions are alternatively fragmented or reacted so as to produce fragment or product ions, and not fragmented or reacted or fragmented or reacted to a lesser degree, a Multiple Reaction Monitoring ("MRM") mode of operation, a Data Dependent Analysis ("DDA") mode of operation, a Data Independent Analysis ("DIA") mode of operation, a Quantification mode of operation or an Ion Mobility Spectrometry ("IMS") mode of operation.

BRIEF DESCRIPTION OF THE DRAWINGS

Various embodiments together with other arrangements given for illustrative purposes only will now be described, by way of example only, and with reference to the accompanying drawings in which.

DETAILED DESCRIPTION

Figure 1:
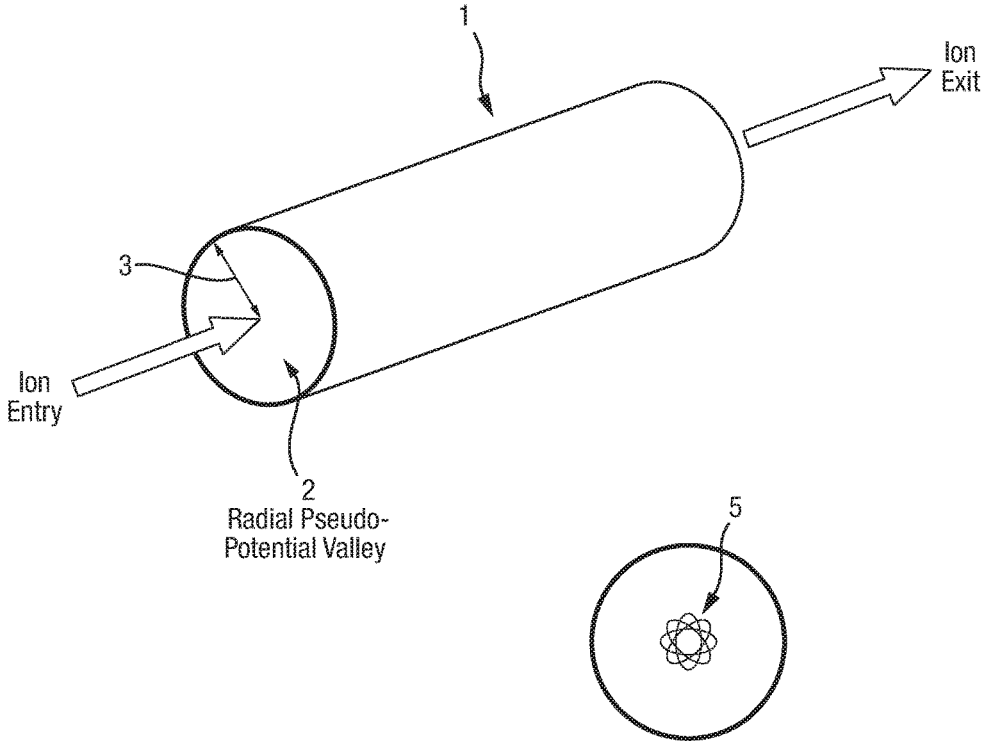
Fig. 1 PRIOR ART
FIG. 1 shows a conventional RF ion guide.

A conventional RF ion guide 1 is shown in FIG. 1. An RF voltage is applied to the electrodes forming the ion guide so that a single pseudo-potential valley or well 2 is generated or created within the ion guide 1. Ions are confined radially 3 within the ion guide 1. A mixture of ions and gas may enter the ion guide 1 generally along the central longitudinal axis of the ion guide 1 and the ions and gas will also exit the ion guide 1 generally along the central longitudinal axis. An ion cloud 5 is confined within the ion guide 1 and the ions are confined generally close to the longitudinal axis by the pseudo-potential well 2. In this arrangement, the ion cloud 5 is fairly diffuse and the ions and gas will exit the ion guide 1 together.

Figure 2:
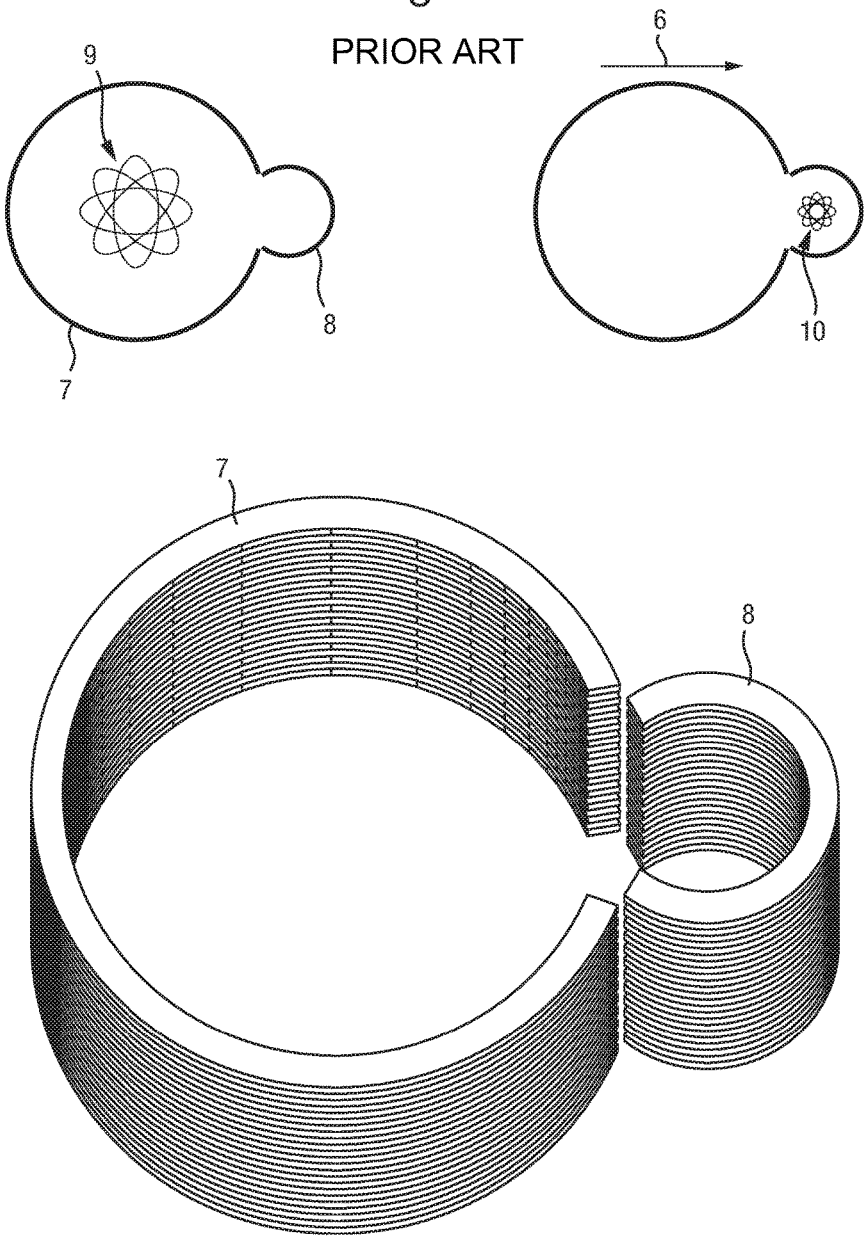
Fig. 2 PRIOR ART
FIG. 2 shows an existing ion guide comprising conjoined ion guide portions.

A further known ion guide is shown in FIG. 2. The ion guide comprises a first ion guide portion 7 and a second ion guide portion 8. The first ion guide portion 7 has a larger radial cross-section than the second ion guide portion 8. A diffuse source of gas and ions 9 is initially constrained or confined within the first ion guide portion 7. Ions initially flow through the first ion guide portion 7 for at least a portion of the axial length of the first ion guide portion 7. The ion cloud 9 formed within the first ion guide portion 7 is radially constrained but may be relatively diffuse. All the electrodes forming the first ion guide portion 7 are maintained at the same first potential and all the electrodes forming the second ion guide portion 8 are maintained at the same second different potential. As a result, a potential difference is maintained between the first ion guide portion 7 and the second ion guide portion 8 and hence ions are caused to migrate from the first ion guide portion 7 to the second ion guide portion 8 across a relatively low amplitude pseudo-potential barrier. The pseudo-potential barrier is located at the junction or boundary region between the first ion guide portion 7 and the second ion guide portion 8. The arrangement of electrodes and the potential difference which is maintained between the electrodes of the two ion guide portions 7,8 has the effect of causing ions from a relatively diffuse ion cloud 9 in the first ion guide portion 7 to be focussed into a substantially more compact ion cloud 10 in the second ion guide portion 8. Presence of background gas in the first ion guide portion 7 and also in the second ion guide portion 8 also causes the ion cloud to be cooled as it passes from the first ion guide portion 7 to the second ion guide portion 8. The majority of any background gas will exit from the first ion guide portion 7 whereas the ions will exit from the second ion guide portion 8.

Figure 3:
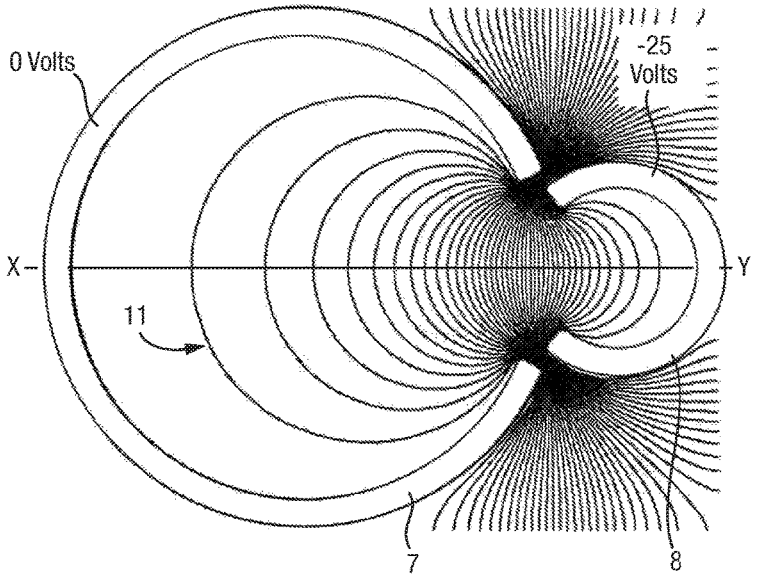
Fig. 3 PRIOR ART
FIG. 3 shows equipotential contours for the ion guide of FIG. 2 together with a corresponding DC potential surface.
Figure 3:
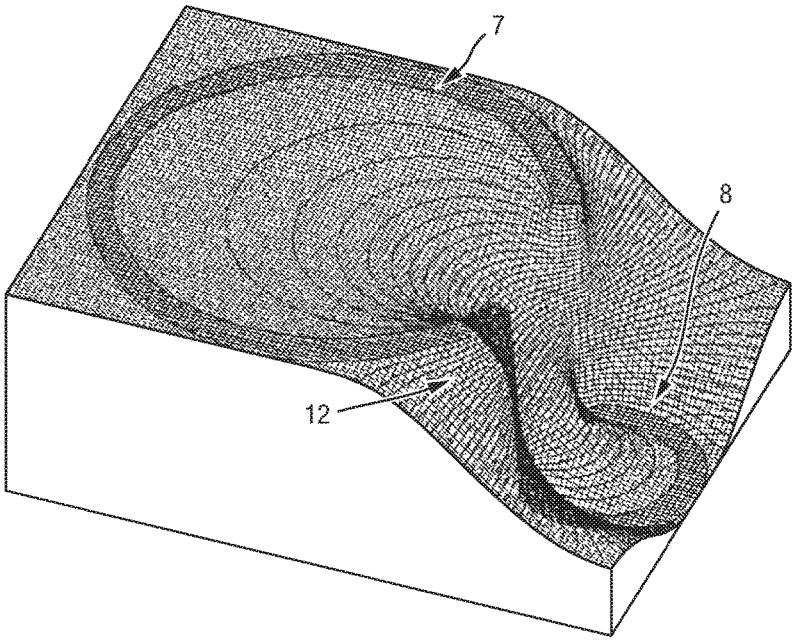
Fig. 3 PRIOR ART

FIG. 3 shows equipotential contours 11 and the DC potential surface 12 which result when a potential difference of 25 V is maintained between the electrodes forming the first ion guide portion 7 and the electrodes forming the second ion guide portion 8.

Figure 4:
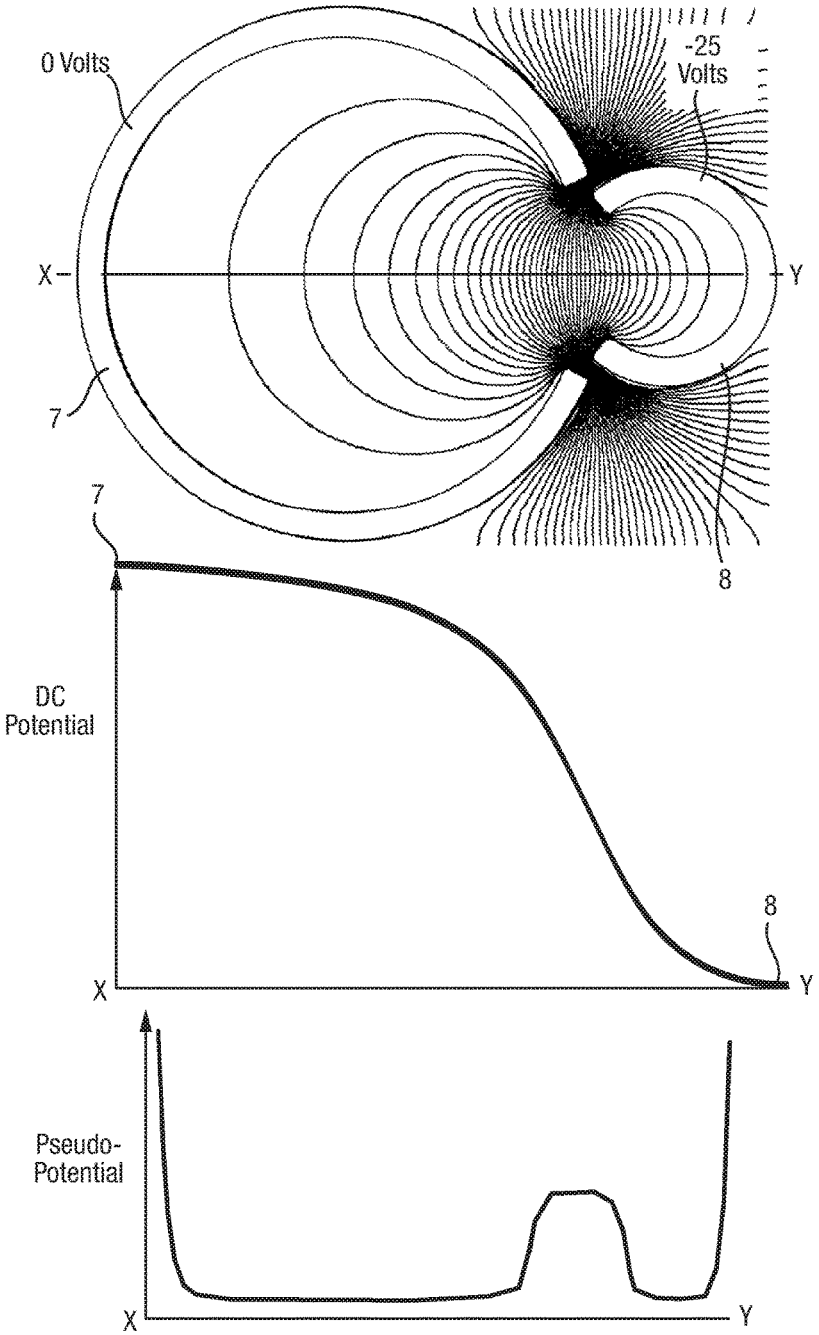
Fig. 4 PRIOR ART
FIG. 4 shows the equipotential contours for the ion guide of FIG. 2 together with plots of DC potential and pseudo-potential across the ion guide.

FIG. 4 shows the same equipotential contours 11 as shown in FIG. 3 together with a plot showing how the DC potential varies in a direction along a line XY due to the applied potential difference. An RF-generated pseudo-potential along the line XY in the absence of a potential difference between the first ion guide portion 7 and the second ion guide portion 8 is also shown. It should be noted that the DC potential is substantially constant and then drops abruptly where the first ion guide portion 7 and second ion guide portion 8 meet. This can have some significant negative effects. For example, some ions in the first ion guide portion 7 which are relatively close to the second ion guide portion 8 may experience a very strong electric field and hence may be accelerated to such an extent that these ions will then undergo unwanted activation and/or fragmentation. Furthermore, other ions in the first ion guide portion 7 which are relatively further away from the second ion guide portion 8 may experience only relatively weak electric field and hence may not be transferred from the first ion guide portion 7 to the second ion guide portion 8.

Figure 5:
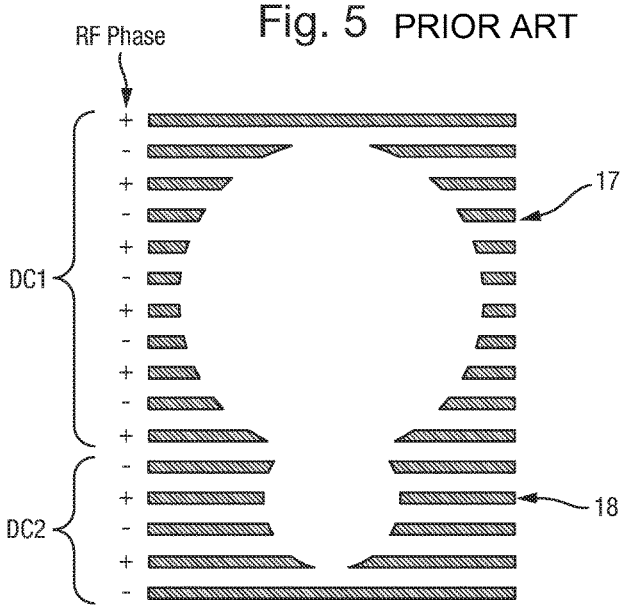
Fig. 5 PRIOR ART
FIG. 5 shows an ion guide according to an embodiment having first and second conjoined ion guide portions.

An ion guide according to an embodiment is shown in FIG. 5. FIG. 5 shows a cross-section of the ion guide. The ion guide comprises a first ion guide portion 17 and a second ion guide portion 18, wherein the first ion guide portion 17 has an ion guiding region with a larger radial cross section than that of the second ion guide portion 18. According to this embodiment, the ion guide portions each comprise a plurality of stacked plate electrodes rather than ring electrodes. Adjacent plate electrodes are maintained at opposite phases of an RF voltage (+ or − as shown in FIG. 5). The plate electrodes which form the first ion guide portion 17 are maintained at a first DC potential (DC1 as indicated in FIG. 5) and the plate electrodes which form the second ion guide portion 18 are maintained at a second different DC potential (DC2 as indicated in FIG. 5). A potential difference (i.e. DC2−DC1) is accordingly maintained between the first ion guide portion 17 and the second ion guide portion 18. As a result, in use at least some ions are caused to migrate from the first ion guide portion 17 to the second ion guide portion 18.

Figure 6:
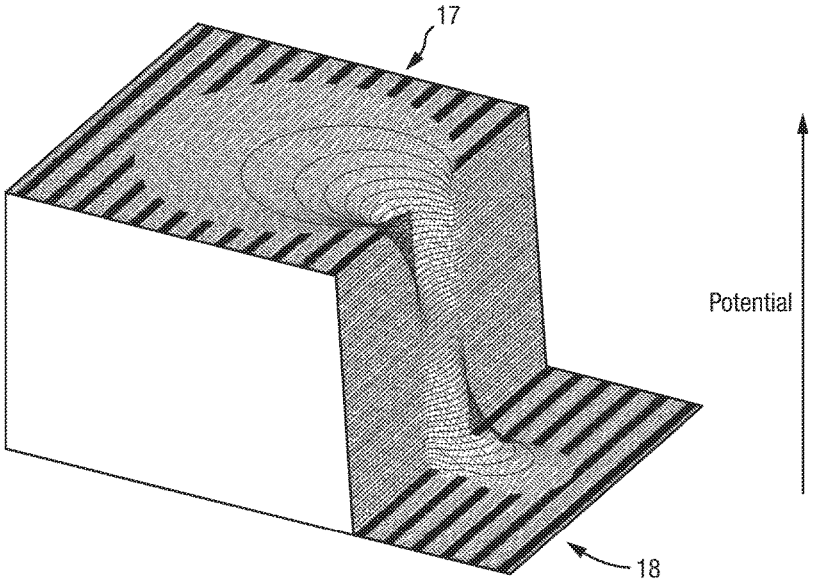
FIG. 6 shows a DC potential surface for the ion guide of FIG. 5.

FIG. 6 shows the DC potential surface 12 which results when the potential difference is provided between the first ion guide portion 17 and the second ion guide portion 18 in the manner shown in FIG. 5.

Figure 7:
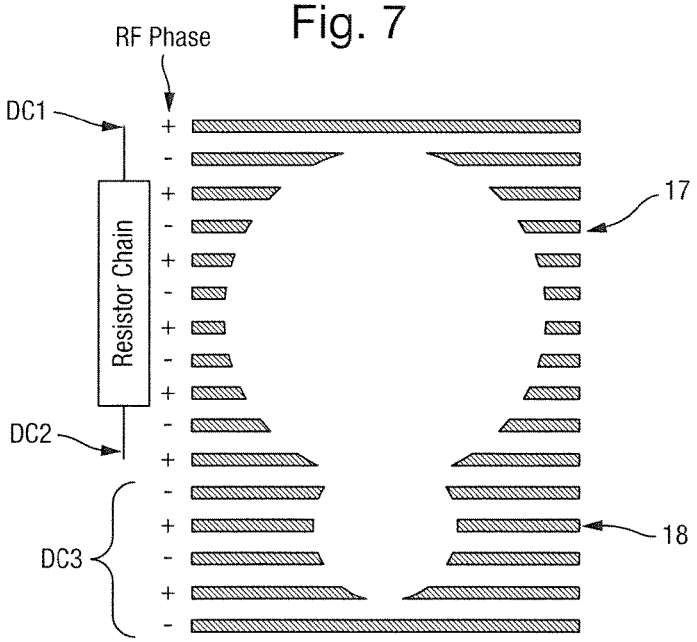
FIG. 7 shows an ion guide according to an embodiment having first and second conjoined ion guide portions wherein a set of plural different potentials are applied to the first ion guide portion via a resistor chain.

FIG. 7 shows a cross sectional view of an ion guide according to another embodiment. The ion guide comprises a first ion guide portion 17 and a second ion guide portion 18, wherein the first ion guide portion 17 has an ion guiding region with a larger radial cross section than that of the second ion guide portion 18. In this embodiment, the ion guide portions 17,18 each comprise a plurality of stacked plate electrodes, with adjacent plate electrodes being maintained at opposite phases of an RF voltage (+ or − as shown in FIG. 7).

In the embodiment shown in FIG. 7 the plate electrodes which form the first ion guide portion 17 are respectively maintained at a plurality of different DC voltages or potentials ranging from a first DC potential (DC1) to a second DC potential (DC2). In this embodiment, DC1 is higher than DC2. A plurality of different DC potentials are provided to the electrodes of the first ion guide portion 17 by a resistor chain which is electrically connected between the first DC potential (DC1) and the second DC potential (DC2). Accordingly, the first and second DC potentials and the points between the resistors in the resistor chain are electrically connected to respective electrodes of the first ion guide portion 17.

According to other embodiments, the plurality of different potentials may instead be individually generated and directly connected to respective electrodes of the first ion guide portion 17.

The plate electrodes which form the second ion guide portion 18 may be maintained at a third DC potential (DC3) which may be lower than both the first DC potential (DC1) and the second DC potential (DC2). A potential difference (that ranges from DC3−DC1 furthest from the second ion guide portion 18 to DC2−DC1 closer to the second ion guide portion 18) may accordingly be maintained between the first ion guide portion 17 and the second ion guide portion 18.

Figure 8:
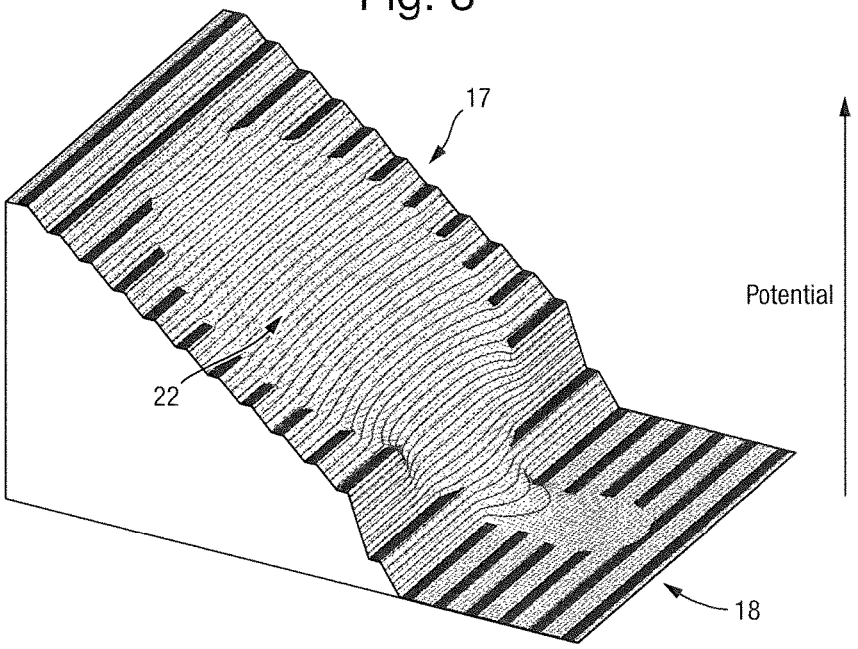
FIG. 8 shows a DC potential surface for the ion guide of FIG. 7.

FIG. 8 shows the resulting DC potential surface 22 which results when a plurality of different potentials are provided to the electrodes of the first ion guide portion 17 in the manner as shown and described above in relation to FIG. 7. According to this embodiment, the ions each experience a substantially similar electric field irrespective of their (radial) position within the first ion guide portion 17. As a result, ions are caused to migrate from the first ion guide portion 17 to the second ion guide portion 18 in a substantially controlled manner, whilst also ensuring sufficient transfer of the ions furthest from the second ion guide portion 18.

Figure 9A:
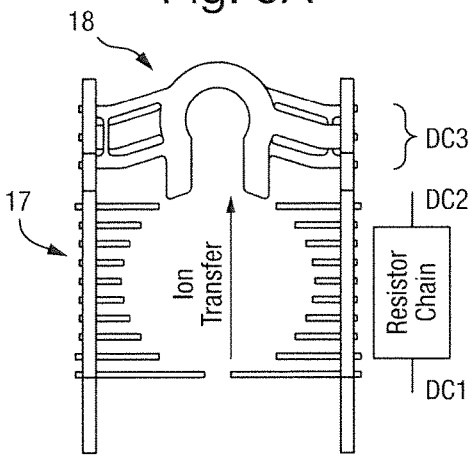
FIG. 9A shows a cross-sectional view of an ion guide according to an embodiment.
Figure 9B:
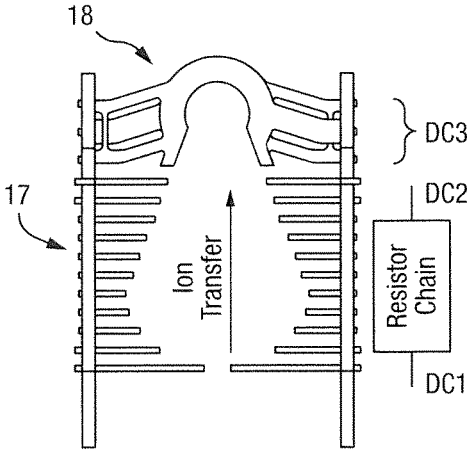
FIG. 9B shows a cross-sectional view of an ion guide according to another embodiment and FIG. 9C shows a cross-sectional view of an ion guide according to another embodiment.
Figure 9C:
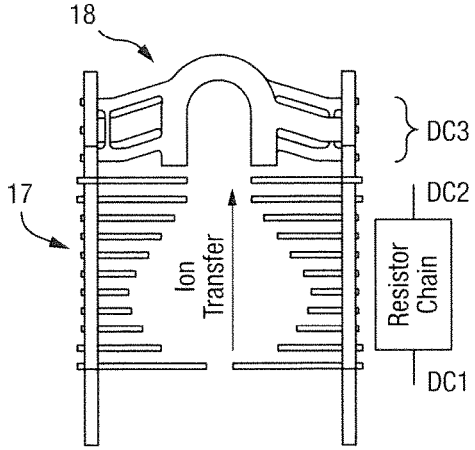

Although the above embodiment relates to an embodiment wherein the two conjoined ion guide portions 17,18 comprise stacked plate electrodes other embodiments are also contemplated comprising combinations of different types of ion guide portion. For example, as will be explained in more detail below, FIGS. 9A-9C show cross-sectional views of hybrid ion guides according to alternative embodiments wherein the first ion guide portion 17 comprises a stacked plate ion guide portion and the second ion guide portion 18 comprises a ring electrode ion guide portion. These ion guides may be referred to as hybrid ion guides.

In the embodiment shown in FIG. 9A the ion guiding region of the first ion guide portion 17 is substantially circular in cross-section. The ring electrodes of the second ion guide portion 18 are substantially key-hole shaped, wherein sections of the ring electrodes that are open to the first ion guide portion 17 extend substantially parallel to one another. In the embodiment shown in FIG. 9B the first ion guiding region of the first ion guide portion 17 tapers lineally towards the second ion guide portion 18. The ring electrodes of the second ion guide portion 18 are substantially key-hole shaped but the sections of the ring electrodes that are open to the first ion guide portion 17 extend away from one another.

In the embodiment shown in FIG. 9C the first ion guiding region of the first ion guide portion 17 tapers towards the second ion guide portion 18. However, the ring electrodes of the second ion guide portion 18 in this embodiment are substantially horse-shoe shaped and the sections of the ring electrodes that are open to the first ion guide portion 17 extend substantially parallel to one another. Other hybrid ion guide embodiments are also contemplated.

Figure 10:
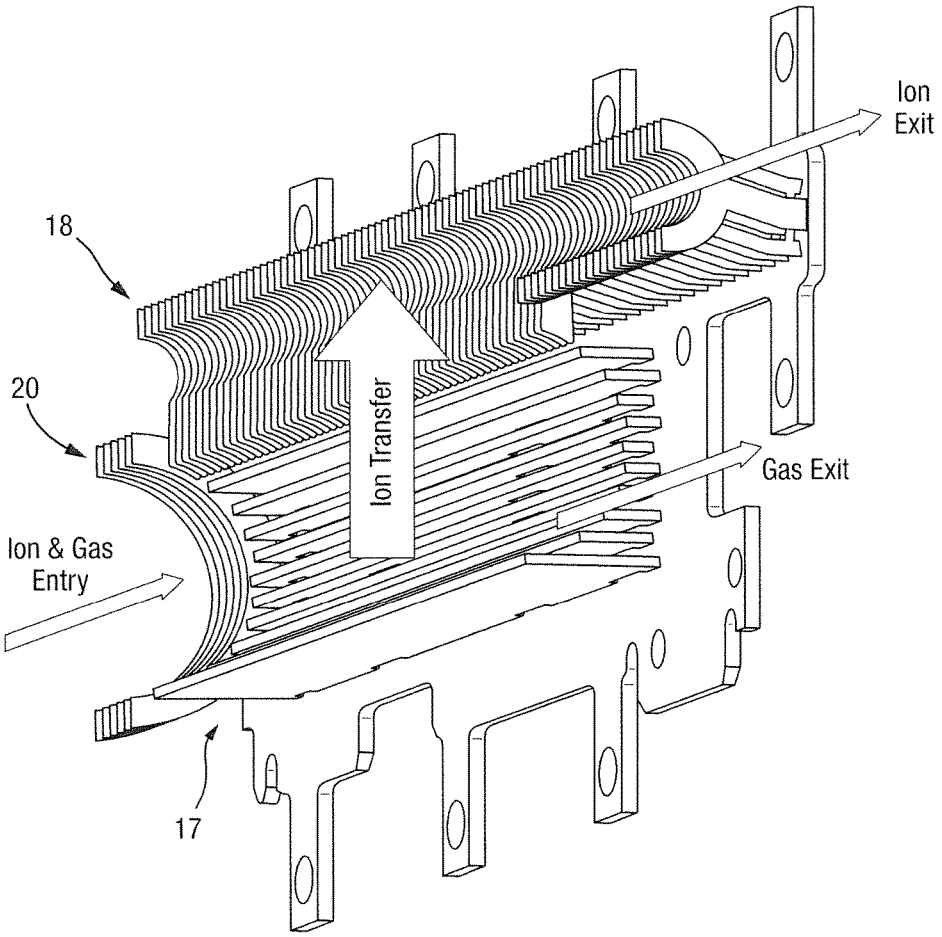
FIG. 10 shows a perspective view of a section of the ion guide of FIG. 9A.

FIG. 10 shows a perspective view of an ion guide similar to that shown in FIG. 9A in greater detail. In this embodiment, the ion guide is provided within a first vacuum chamber of a mass spectrometer which is evacuated by a vacuum pump. FIG. 10 indicates a mixture of gas (e.g. nitrogen) and ions entering the first ion guide portion 17 through a plurality of entrance ring electrodes 20. The ring electrodes may have an internal diameter of 15 mm. An RF voltage having an amplitude of 300 V peak to peak and a frequency of 1 MHz may be applied to the ring electrodes 20 and/or also to the electrodes forming the first ion guide portion 17. A relatively diffuse cloud of ions is therefore initially constrained within the first ion guide portion 17. The first ion guide portion 17 comprises a plurality of plate or planar electrodes which are arranged in planes which are orthogonal to the planes of the ring electrodes 20. The first ion guide portion 17 is arranged adjacent a second ion guide portion 18 comprising a plurality of key-hole shaped electrodes which are arranged in planes which are parallel to the planes of the ring electrodes 20 and therefore which are orthogonal to the planes of the plate or planar electrodes of the first ion guide portion 17.

A DC potential difference is applied or maintained between the first ion guide portion 17 and the second ion guide portion 18. A plurality different DC voltages or potentials are also applied to respective plate electrodes of the first ion guide portion 17 in a similar manner to the embodiments which are discussed above with reference to FIGS. 7-8. As a result, ions are transferred from the first ion guide portion 17 to the second ion guide portion 18 in a substantially controlled manner. The bulk of the gas flow, on the other hand, separately exits the ion guide and then exits the vacuum chamber via a pumping port that is substantially aligned with the central axis of the first ion guide portion 17.

The second ion guide portion 18 may have an internal diameter of 5 mm. An RF voltage having an amplitude of 300 V peak to peak and a frequency of 1 MHz may also be applied to the electrodes forming the second ion guide portion 18, although in other embodiments the first ion guide portion 17 and second ion guide portion 18 may receive different RF voltage amplitudes and/or frequencies to one another. As a result, ions which are transferred from the first ion guide portion 17 into the second ion guide portion 18 form a relatively compact ion cloud within the second ion guide portion 18. The second ion guide portion 18 may extend axially or longitudinally beyond the first ion guide portion 17 and may onwardly transport ions to a differential pumping aperture (not shown). Ions may then be onwardly transmitted into subsequent stages of the mass spectrometer for subsequent analysis and detection.

The various ion guides having first and second ion guide portions discussed above, including the ion guide shown and described above with reference to FIG. 10, allow ions to be moved or directed away from the bulk of the gas flow. The ions are also brought into tighter ion confinement for optimum transmission through a differential pump aperture into a subsequent vacuum stage. Furthermore, as discussed above, the set of plural different voltages or potentials which may be applied to the first ion guide portion 17 provides for more controlled and effective transfer of ions between the first ion guide portion 17 and the second ion guide portion 18.

Figure 11:
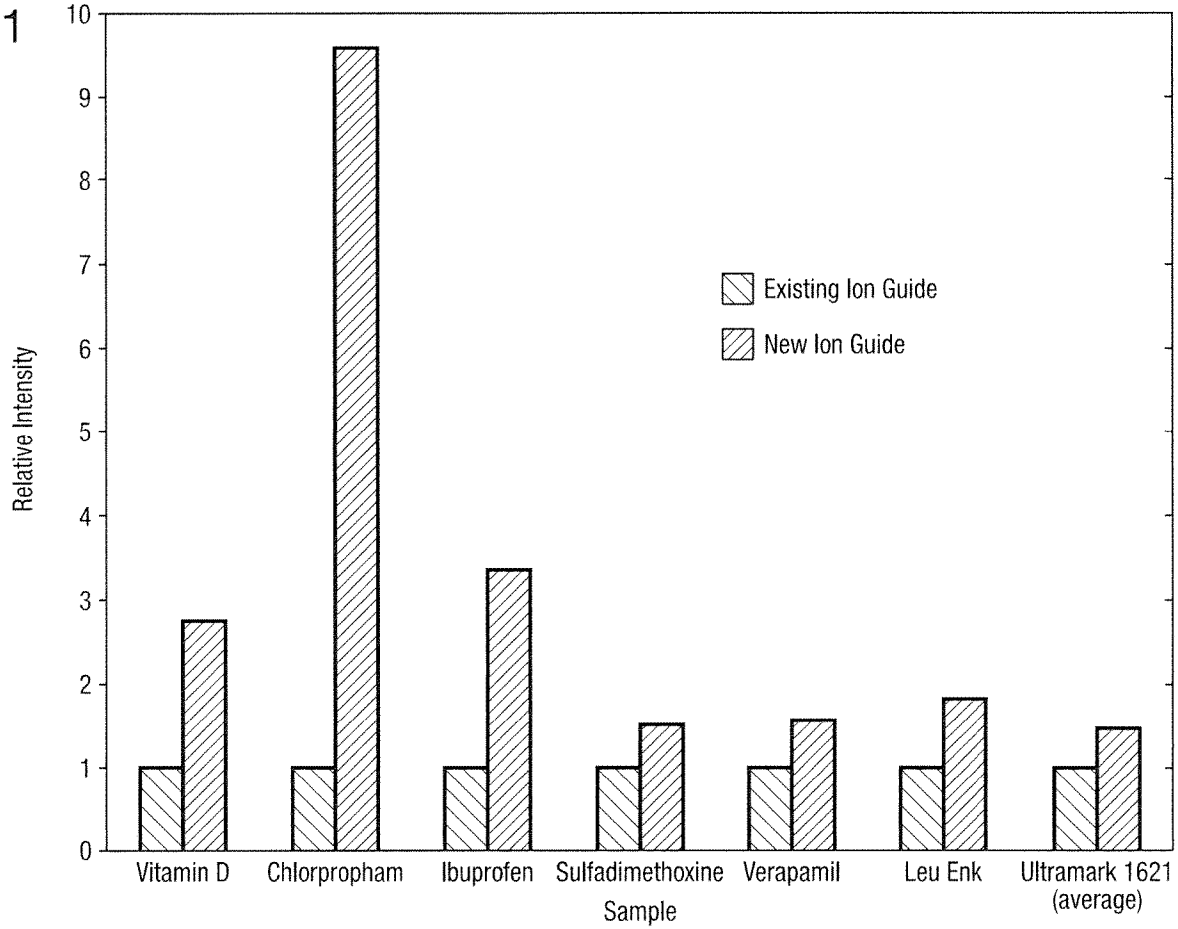
FIG. 11 shows a plot comparing the performance of a known ion guide with performance of the ion guide of FIG. 10.

FIG. 11 shows the relative intensity of ions detected for several different samples when using a conventional ion guide having first and second ion guide portions and an ion guide of the embodiment of FIG. 10 to guide sample ions. As is shown, the ion guide of the embodiment of FIG. 10 provides greater relative intensity of sample ions for each of the samples when compared with the conventional ion guide, particularly for relatively more fragile samples such as Vitamin D, Chloroproham, Ibuprofen, etc. The Ultramark result shown in FIG. 11 is from a combination of the main peaks in the sample (m/z 1122 to 1922).

According to alternative embodiments the ions may be urged radially from the first ion guide portion 17 to the second ion guide portion 18 by a radially moving or travelling potential waveform. For example, according to an embodiment at least two different DC potentials may be sequentially or progressively applied to circumferentially adjacent electrodes or electrode segments that form the first ion guide portion 17 and/or second ion guide portion 18 in order to urge or drive ions radially between the first ion guide portion 17 and the second ion guide portion 18.

According to various embodiments, the ions may also be driven axially or longitudinally along at least a portion of the first ion guide portion 17 and/or along at least a portion of the second ion guide portion 18 by an axially or longitudinally moving or travelling potential waveform. For example, according to an embodiment one or more DC transient potentials may be progressively applied to axially or longitudinally adjacent or neighbouring electrodes or electrode segments forming the first ion guide portion 17 and/or second ion guide portion 18 in order to urge or drive ions axially or longitudinally along at least a portion of the first ion guide portion 17 and/or second ion guide portion 18.

A pseudo-potential barrier may be formed between the two conjoined ion guide portions 17,18. The pseudo-potential barrier may have an effective amplitude which is mass to charge ratio dependent. Appropriate RF voltages may then be used and a potential difference may be maintained between the axes of the two ion guide portions 17,18 such that ions may be mass selectivity transferred between the two ion guide portions 17,18. For example, the amplitude and/or frequency of an AC or RF voltage applied to the electrodes of the two ion guide portions 17,18 may be progressively varied or scanned. As a result, ions may be mass selectively transferred between the two ion guide portions 17,18 as a function of time and/or as a function of axial or longitudinal position along the ion guide portions 17,18.

Further embodiments are also contemplated wherein more than two parallel ion guide portions may be provided. For example, according to further embodiments at least 3, 4, 5, 6, 7, 8, 9 or 10 parallel ion guide portions or ion guiding regions may be provided. Ions may be switched between the plurality of parallel ion guide portions as desired.

Although the present invention has been described with reference to various embodiments, it will be understood by those skilled in the art that various changes in form and detail may be made without departing from the scope of the invention as set forth in the accompanying claims.

The invention claimed is:

1. A method of guiding ions comprising:

providing an ion guide, wherein said ion guide comprises:

(i) a first ion guide portion comprising a first plurality of electrodes, wherein a first ion guiding path is formed along or within said first ion guide portion;

(ii) a second ion guide portion comprising a second plurality of electrodes, wherein a second different ion guiding path is formed along or within said second ion guide portion, and wherein said first ion guiding path and said second ion guiding path are substantially parallel to one another;

wherein said first ion guiding path comprises:

a first portion of said first ion guiding path which is closest or proximal to said second ion guiding path in a direction substantially orthogonal to a longitudinal axis of said first ion guiding path and a second portion of said first ion guiding path which is furthest or distal from said second ion guiding path in said direction substantially orthogonal to said longitudinal axis of said first ion guiding path; and (iii) a first device comprising:

a resistor chain interconnected between electrodes or electrode segments of said first plurality of electrodes, wherein said electrodes or electrode segments are distributed along or have different positions with respect to said direction that is substantially orthogonal to said longitudinal axis of said first ion guiding path; or a plurality of voltage supplies respectively connected to electrodes or electrode segments of said first plurality of electrodes, wherein said electrodes or electrode segments are distributed along or have different positions with respect to said direction that is substantially orthogonal to said longitudinal axis of said first ion guiding path;

wherein the method further comprises:

applying, by said first device, a plurality of different first DC voltages or potentials to said electrodes or electrode segments of said first plurality of electrodes in order to generate a DC electric field which directs ions from said first ion guiding path into said second ion guiding path, wherein said DC electric field is maintained across said first ion guiding path such that an electric field gradient across said first portion is substantially the same as an electric field gradient across said second portion with respect to said direction substantially orthogonal to said longitudinal axis of said first ion guiding path; and applying one or more second voltages or potentials to said second plurality of electrodes in order to generate a second DC electric field, such that a second electric field gradient across said second ion guiding path with respect to said direction substantially orthogonal to the longitudinal axis of said first ion guiding path is substantially different to said electric field gradient(s) across said first and second portions of said first ion guiding path;

wherein said second plurality of voltages or potentials are selected such that said second electric field gradient across said second ion guiding path with respect to said direction substantially orthogonal to the longitudinal axis of said first ion guiding path is substantially zero.

2. A method of mass spectrometry comprising a method of guiding ions as claimed in claim 1.

3. A method of guiding ions comprising:

providing an ion guide, wherein said ion guide comprises:

(i) a first ion guide portion comprising a first plurality of electrodes, wherein a first ion guiding path is formed along or within said first ion guide portion;

(ii) a second ion guide portion comprising a second plurality of electrodes, wherein a second different ion guiding path is formed along or within said second ion guide portion, and wherein said first ion guiding path and said second ion guiding path are substantially parallel to one another;

wherein said first ion guiding path comprises:

a first portion of said first ion guiding path which is closest or proximal to said second ion guiding path in a direction substantially orthogonal to a longitudinal axis of said first ion guiding path and a second portion of said first ion guiding path which is furthest or distal from said second ion guiding path in said direction substantially orthogonal to said longitudinal axis of said first ion guiding path; and wherein the method further comprises:

applying a plurality of different first DC voltages or potentials to said electrodes or electrode segments of said first plurality of electrodes in order to generate a DC electric field which directs ions from said first ion guiding path into said second ion guiding path, wherein said DC electric field is maintained across said first ion guiding path such that an electric field gradient across said first portion is substantially the same as an electric field gradient across said second portion with respect to said direction substantially orthogonal to said longitudinal axis of said first ion guiding path; and applying one or more second voltages or potentials to said second plurality of electrodes in order to generate a second DC electric field, such that a second electric field gradient across said second ion guiding path with respect to said direction substantially orthogonal to the longitudinal axis of said first ion guiding path is substantially different to said electric field gradient(s) across said first and second portions of said first ion guiding path;

wherein said second plurality of voltages or potentials are selected such that said second electric field gradient across said second ion guiding path with respect to said direction substantially orthogonal to the longitudinal axis of said first ion guiding path is substantially zero.

* * * * *